United States Patent [19]

D'Hoogh

[11] 3,941,932

[45] Mar. 2, 1976

[54] LOUDSPEAKER HAVING A VOICE COIL AND A PIEZOELECTRIC FEEDBACK TRANSDUCER

[75] Inventor: Guido Odilon Maurits D'Hoogh, Eindhoven, Netherlands

[73] Assignee: U.S. Philips Corporation, New York, N.Y.

[22] Filed: May 29, 1974

[21] Appl. No.: 474,450

[30] Foreign Application Priority Data

June 12, 1973 Netherlands ..... 7308103

[52] U.S. Cl. ..... 179/1 F; 179/115.5 R; 179/110 A

[51] Int. Cl.[2] ..... H04R 3/08; H04R 23/02

[58] Field of Search ..... 179/110 A, 110 D, 1 F, 179/115.5 R

[56] References Cited

UNITED STATES PATENTS

| | | | |
|---|---|---|---|
| 1,932,460 | 10/1933 | Rockwell | 179/1 F |
| 2,860,183 | 11/1958 | Conrad | 179/1 F |
| 2,948,778 | 8/1960 | Clements | 179/1 F |
| 3,334,184 | 8/1967 | De Koning | 179/1 F |

*Primary Examiner*—Kathleen Claffy
*Assistant Examiner*—George G. Stellar
*Attorney, Agent, or Firm*—Frank R. Trifari; Bernard Franzblau

[57] ABSTRACT

Loudspeaker, in particular low-note loudspeaker, provided with a cone-shaped diaphragm having a coil form on which in addition to the voice coil is mounted a piezoelectric transducer in the form of a thin plate capable of pivotal movement. The output voltage of the transducer is degeneratively fed back to the input of an associated amplifier. The plate preferably is rectangular and suspended in rubber mounts along two opposed edges. The mounts form part of a mounting board provided with printed wiring on which an electronic transformation circuit is arranged. A shallow cup in which the mounting board is accommodated ensures that the piezoelectric plate is separated in an airtight manner from the coil form.

10 Claims, 5 Drawing Figures

LOUDSPEAKER HAVING A VOICE COIL AND A PIEZOELECTRIC FEEDBACK TRANSDUCER

The invention relates to a loudspeaker provided with a conical diaphragm having a coil form on which are mounted a voice coil and a piezoelectric transducer, the output voltage of the transducer being degeneratively fed back to the input of an associated amplifier.

Such a loudspeaker generally is used for the reproduction of low notes below 1,000 Hz. German patent specification 967,167 describes what is referred to as a motional feedback loudspeaker using a piezoelectric transducer which is clamped at one end with the result that the output voltage is not truly proportional to the acceleration of the loudspeaker cone. In U.S. Pat. No. 3,334,184, there is shown another motional feedback loudspeaker having a piezoelectric transducer secured to the apex of a conical member which has its base secured to the loudspeaker diaphragm. The transducer provides a negative feedback voltage that corresponds to the axial acceleration of the cone diaphragm.

The loudspeaker according to the invention is characterized in that the piezoelectric transducer is in the form of a thin plate hinged to the coil form along two edges of the plate.

This arrangement provides the advantage that the frequency characteristic of the transducer is perfectly straight and constant in a frequency range below 1,000 Hz so that the feedback voltage is directly proportional to the acceleration of the cone.

In a particularly advantageous embodiment the piezoelectric plate is rectangular and suspended in rubber mounts along two opposite edges of the plate. Because the impedance of the piezoelectric transducer is very high, it must be connected to an impedance transformer. In order to avoid the introduction of hum as far as possible, the impedance transformation circuit is preferably located as close as possible to the transducer. Thus the adverse effect of additional parallel capacitances is also avoided.

For this purpose an embodiment of the invention is characterized in that the mounts are accommodated in a printed circuit board on which the discrete electric components are mounted which together form an impedance transformer.

The printed circuit board advantageously is placed in a shallow cup which forms an entirely airtight separation between the piezoelectric transducer and the coil form.

Owing to the airtight separation any influence which the air which follows the cone motion in the coil form might otherwise exert on the hinged piezoelectric plate is avoided.

The natural frequency of the transducer is determined by its mass and by the stiffness of the clamping. A suitable choice of the amount of solder used to establish electric connections to the two electrodes of the piezoelectric plate enables the natural frequency of the entire transducer including its suspension to be readily maintained above 3,000 Hz.

An embodiment of the invention will now be described, by way of example, with reference to the accompanying diagrammatic drawings, in which.

Figure 4:
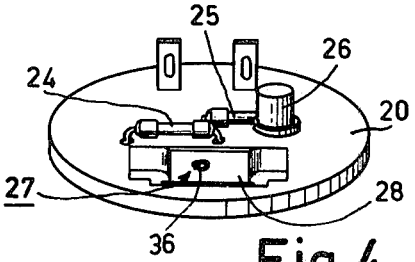
Figure 5:
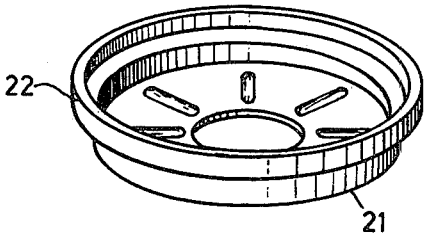

FIGS. 4 and 5 together are an exploded view of the insert.

Figure 1:
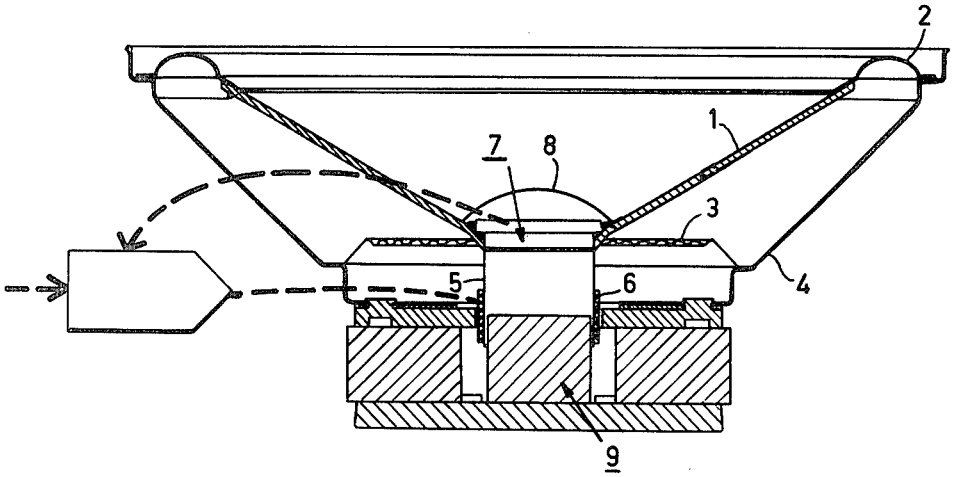
FIG. 1 is a cross-sectional view of a loudspeaker according to the invention.

The larger part of the loudspeaker shown in FIG. 1 has long been known. A cone-shaped diaphragm 1 made of paper fibres is suspended from a metal frame via a rubber surround 2 and a spider 3.

A coil form 5 carrying a voice coil 6 is adhesively secured to the central part of the cone 1. In this operation an insert 7 which carries the piezoelectric transducer is also secured in place. The transducer produces a voltage in response to vibration of the coil form which, in a frequency range up to 1,000 Hz, is directly proportional to the acceleration of the central part of the cone.

In the usual manner a hood 8 excludes dust from the upper end of the coil form 5 and, in this embodiment, from the insert 7.

The voice coil 6 is arranged in the operational air gap of a magnet system 9 to which is secured the cone frame 4.

Figure 2:
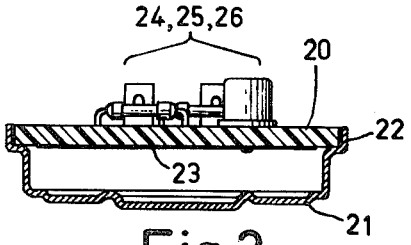
FIG. 2 is a cross-sectional view of the insert including the transducer.

The insert 7 shown in FIG. 2 comprises a mounting board 20 which is clamped in a shallow cup 21. The board is clamped in a rim 22. The mounting board is made of a synthetic material, for example that available under the registered trademark Pertinax, and on its lower surface is provided with printed wiring 23. On its upper surface electronic components 24, 25 and 26, which together form an impedance transformation circuit, are connected to one another and to a transducer 27 by means of the printed wiring 23.

Figure 3:
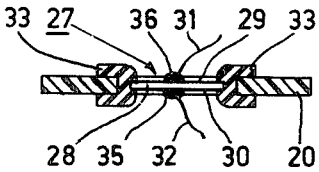
FIG. 3 is a cross-sectional view of the clamped transducer.

The transducer 27 is a rectangular plate 28 which comprises two oppositely polarised layers of a piezoelectric ceramic material. On the two major surfaces of the plate metal electrodes 29 and 30 are deposited from vapour. The electrodes 29 and 30 are connected to leads 31 and 32 respectively, by soldering. The plate is clamped at two opposite parallel edges in rubber mounts 33 and 34 which in turn are secured to the mounting board (FIGS. 3 and 4). Clamping is such as to allow pivotal movement of the plate. The cup is secured to the coil form so that vibration of the coil form is transmitted to the mounting board and hence to the piezoelectric plate. The mounting of the piezoelectric plate places it within the circumference of the voice coil with its major surfaces lying in a plane substantially normal to the axis of the voice coil.

The mass of the plate and the stiffness of the clamping together determine the resonant frequency of the transducer.

In order to ensure that this resonant frequency lies outside the operating range of the loudspeaker, larger solder contacts 35 and 36 are used with a consequent increase in the mass of the plate.

The cup 21 (FIG. 5) serves to separate the transducer from the coil form in an airtight manner in order to avoid troublesome effects which the vibrating column of air in the coil form might otherwise exert on the pivoting transducer plate.

A practical embodiment had the following values:
diameter of the loudspeaker cone: 200 mm,
weight of the loudspeaker cone: 9 g,
weight of the voice coil: 6 g,
size of the piezoelectric plate: 8 mm by 8 mm,
thickness of the piezoelectric plate: 0.6 mm,
weight of the piezoelectric plate: 0.32 g,
weight of the drops of solder: 0.1 g.

What is claimed is:

1. A loudspeaker comprising, a cone-shaped vibratory diaphragm having an inner portion secured to a coil form, a voice coil mounted on the coil form, means including the voice coil for vibrating the coil form and diaphragm, a piezoelectric transducer mounted on the coil form and comprising a thin plate of piezoelectric material having two opposed edges hingedly connected to the coil form and situated within the circumference of said voice coil and with its major surfaces lying in a plane substantially normal to the axis of the voice coil, and means for degeneratively coupling the output voltage of the piezoelectric transducer to an input of an amplifier adapted to drive the voice coil.

2. A loudspeaker as claimed in claim 1 wherein the piezoelectric plate is rectangular and is clamped in rubber mounts along two opposed edges of the plate.

3. A loudspeaker as claimed in claim 2, wherein the mounts are accommodated in a mounting board provided with printed wiring and on which electric components are inserted which together form an impedance transformer.

4. A loudspeaker as claimed in claim 2, further comprising a mounting board on which the rubber mounts are supported and wherein the mounting board is accommodated in a shallow cup which is coupled to the coil form and separates the piezoelectric transducer from the coil form in an airtight manner.

5. A loudspeaker as claimed in claim 1 wherein the piezoelectric plate includes first and second electrodes and first and second electric connections connected to said first and second electrodes respectively, by means of solder drops of sufficient size to cause the natural frequency of the transducer and its suspension to exceed 3000 Hz.

6. A loudspeaker comprising, a cone-shaped vibratory diaphragm having an inner portion secured to a coil form and an outer portion attached to a support member, a voice coil attached to the coil form for vibrating the coil form and the attached diaphragm, a transducer comprising a plate of piezoelectric material, means for mounting said piezoelectric plate on the coil form in non-cantilevered fashion within the circumference of said voice coil and with its major surfaces lying in a plane substantially normal to the axis of the voice coil so as to allow pivotal movement of the plate, and means for coupling the output voltage of the transducer to an input of an amplifier adapted to drive said coil.

7. A loudspeaker as claimed in claim 6 wherein the piezoelectric plate has a rectangular shape and said mounting means comprises, a mounting board mechanically coupled to the coil form and means for pivotally supporting the piezoelectric plate on the mounting board along opposed edges of the plate.

8. A loudspeaker as claimed in claim 7 wherein said mounting means further comprises a cup-shaped member supported by the coil form and in which the mounting board is supported so that the cup-shaped member separates the piezoelectric plate from the coil form in an airtight manner thereby to isolate said plate from the effects of air movements produced by movement of the coil form.

9. A loudspeaker as claimed in claim 7 wherein the mass of the transducer and the stiffness of the pivotal supporting means are chosen so that the resonant frequency of the transducer and its pivotal supporting means exceed the operating frequency range of the loudspeaker.

10. A loudspeaker as claimed in claim 6 wherein said coupling means is connected to feed back the transducer output voltage to provide a degenerative action in said amplifier.

* * * * *